US007874468B2

(12) United States Patent
Hansen et al.

(10) Patent No.: US 7,874,468 B2
(45) Date of Patent: Jan. 25, 2011

(54) SIZER FOR A GARMENT HANGER AND GARMENT HANGER HAVING A SIZER

(75) Inventors: James Hansen, Coopersville, MI (US); Russell O. Blanchard, Zeeland, MI (US)

(73) Assignee: Hangers Plus, LLC, Coopersville, MI (US)

( * ) Notice: Subject to any disclaimer, the term of this patent is extended or adjusted under 35 U.S.C. 154(b) by 85 days.

(21) Appl. No.: 12/156,707

(22) Filed: Jun. 4, 2008

(65) Prior Publication Data

US 2009/0302074 A1 Dec. 10, 2009

(51) Int. Cl.
*A41D 27/22* (2006.01)

(52) U.S. Cl. ..... 223/85; 40/322

(58) Field of Classification Search ..... 223/85, 223/88, 92, 95; 40/322; D6/328
See application file for complete search history.

(56) References Cited

U.S. PATENT DOCUMENTS

| | | | | | |
|---|---|---|---|---|---|
| 4,198,773 | A * | 4/1980 | Batts et al. | 40/322 |
| 4,322,902 | A * | 4/1982 | Lenthall | 40/322 |
| D302,214 | S * | 7/1989 | Wilson | D6/318 |
| 4,881,836 | A * | 11/1989 | Blanchard | 40/322 |
| 5,377,884 | A * | 1/1995 | Zuckerman | 223/85 |
| 5,503,310 | A * | 4/1996 | Zuckerman et al. | 223/85 |
| 5,641,100 | A * | 6/1997 | Mitchell et al. | 223/85 |
| D449,744 | S * | 10/2001 | Zuckerman | D6/328 |
| 7,287,674 | B1 * | 10/2007 | Sutton et al. | 223/85 |
| 7,303,101 | B2 * | 12/2007 | Goldman | 223/85 |
| 7,516,875 | B2 * | 4/2009 | Gouldson | 223/85 |
| 2006/0006204 | A1 * | 1/2006 | Mainetti | 223/85 |
| 2006/0213938 | A1 * | 9/2006 | Gouldson | 223/85 |
| 2008/0035685 | A1 * | 2/2008 | Matkovich et al. | 223/85 |
| 2009/0212080 | A1 * | 8/2009 | Goldman | 223/85 |

* cited by examiner

*Primary Examiner*—Gary L Welch
*Assistant Examiner*—Nathan E Durham
(74) *Attorney, Agent, or Firm*—The Watson I.P. Group, PLC; Jovan N. Jovanovic; Vladan M. Vasiljevic

(57) ABSTRACT

A sizer for a garment hanger configured to extend over a garment hanger comprising a body. The body has an outer surface and an inner surface, and defines a cavity with an upper opening and a lower opening. The body further having a central region with a first wall and a second wall spaced apart therefrom, and, a first curved wall spanning between the first wall and the second wall and a second curved wall spanning between the first wall and the second wall. The first and second curved walls are outwardly convex and define a peak region on each of the first and second curved walls. Applying a pinching force upon the first and second curved walls toward each other drives the first wall and second wall further apart, to, in turn, temporarily widen at least one of the lower and the upper openings of the body.

3 Claims, 3 Drawing Sheets

SIZER FOR A GARMENT HANGER AND GARMENT HANGER HAVING A SIZER

BACKGROUND OF THE DISCLOSURE

1. Field of the Invention

The invention relates in general to garment hangers, and more particularly, to a garment hanger having an improved strap holder and sizing system assembly. The strap holder is configured to minimize the inadvertent removal of a strap therefrom. The sizing assembly is configured for the receipt of various different sizing systems, while maintaining an aesthetic appearance where no sizing system is utilized.

2. Background Art

The use of garment hangers for shipping and displaying garments is well known in the art. Garment hangers of this type are typically employed to retain shirts, blouses, jackets, as well as a number of different garments, typically garments for the upper torso.

In many instances, these garment hangers are applied to products at the garment manufacturing or shipping facility. Garments are typically shipped on garment hangers in shipping containers from the location of manufacture (often the far east) to locations throughout the world. While such garment hangers have greatly increased in popularity, there nevertheless exist enhancements which can be made to these garment hangers to improve their usability and reliability.

Current practices utilize a sizing system wherein the size of the garment is identified on the garment hanger. Typically, a sizer having identification thereon relative to the size of the garment (i.e., a number or indicia such as S, M, L, XL, among others) is attached to the garment hanger. Certain sizers require special tools to install and to remove. While it is desirable that sizers are strongly retained by the garment hanger to avoid children dislodging sizers as they pose a choking hazard. Additionally, typical sizers require a very specific structure on the garment hanger itself. As a result, each garment hanger requires a different and specific sizer.

It is an object of the present invention to provide a garment hanger which includes an improved sizing system.

It is another object of the present invention to provide a sizing system which allows for the installation and removal of a sizer without the need for special tools. These objects as well as other objects of the present invention will become apparent in light of the present specification, claims, and drawings.

SUMMARY OF THE DISCLOSURE

The disclosure is directed to a sizer for a garment hanger configured to extend over a garment hanger, and in particular, over a sizer attachment assembly. The sizer comprises a body having an outer surface and an inner surface. The body defines a cavity with an upper opening and a lower opening. The body further has a central region defined by a first wall and a second wall opposing the first wall and spaced apart therefrom, and, a pair of opposing end regions defined by a first curved wall spanning between the first wall and the second wall and a second curved wall spanning between the first wall and the second wall at an end opposite the first curved wall. The first and second curved walls are outwardly convex defining a peak region on each of the first and second curved walls. By applying a pinching force upon the first and second curved walls toward each other, they drive the first wall and second wall further apart. In turn, the pinching force temporarily widens at least one of the lower and the upper openings of the body.

In a preferred embodiment, the body has a substantially symmetrical trapezoidal shape.

In another embodiment, the first wall and the second wall are substantially identical in configuration and substantially planar.

In another embodiment, the first curved wall and the second curved wall each has a substantially conical configuration.

In yet another embodiment, the first wall and the second wall comprise outwardly convex configurations which are substantially continuous with a respective portion of the respective curved wall with which the respective first and second wall interfaces with.

In a preferred embodiment, the first curved wall and the second curved wall comprise a pair of discontinuous curved portions which meet at a respective peak.

In one such embodiment, the cross-sectional configuration of the body of the sizer comprises a football-like configuration.

In another such embodiment, at least a portion of the body of the sizer is relatively thinner than the remainder of the body, to, in turn, facilitate controlled deformation of the sizer upon the application of a pinching force.

In another aspect of the invention, the invention comprises a garment hanger comprising a hanger body having opposing legs, a hook coupled to the body, a hook coupled with the body, a sizer attachment assembly and a sizer. The sizer comprises a body having an outer surface and an inner surface. The body defines a cavity with an upper opening and a lower opening. The body further has a central region defined by a first wall and a second wall opposing the first wall and spaced apart therefrom, and, a pair of opposing end regions defined by a first curved wall spanning between the first wall and the second wall and a second curved wall spanning between the first wall and the second wall at an end opposite the first curved wall. The first and second curved walls are outwardly convex defining a peak region on each of the first and second curved walls. By applying a pinching force upon the first and second curved walls toward each other drives the first wall and second wall further apart. In turn, the pinching force temporarily widens at least one of the lower and the upper openings of the body.

In yet another aspect the disclosure is directed to a method of installing a sizer comprising the steps of providing a garment hanger having a body, a hook and a sizer attachment assembly; providing a sizer of the type described herein; applying a pinching force upon the curved walls to, in turn, widen the at least one opening; passing the sizer over the sizer attachment assembly; and releasing the pinching force from the first and second curved walls.

BRIEF DESCRIPTION OF THE DRAWINGS

The disclosure will now be described with reference to the drawings wherein.

DETAILED DESCRIPTION OF THE DISCLOSURE

Figure 1:
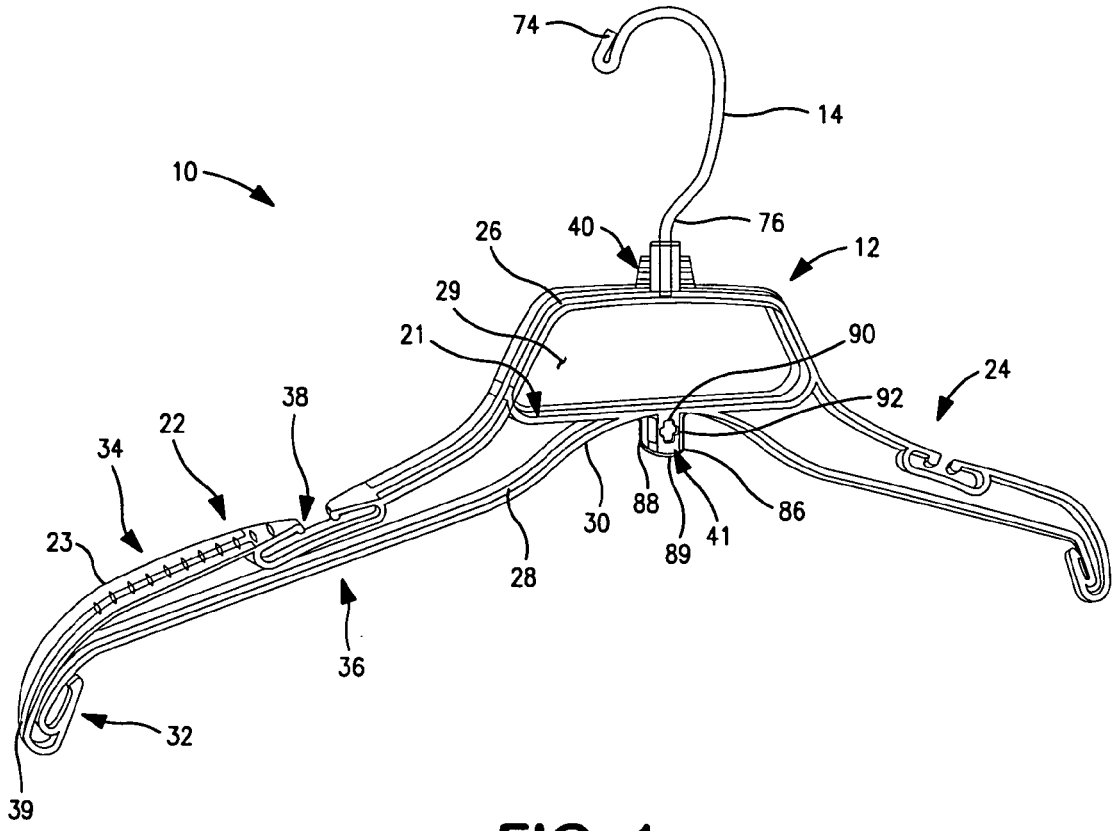
FIG. 1 of the drawings is a perspective view the garment hanger of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 5:
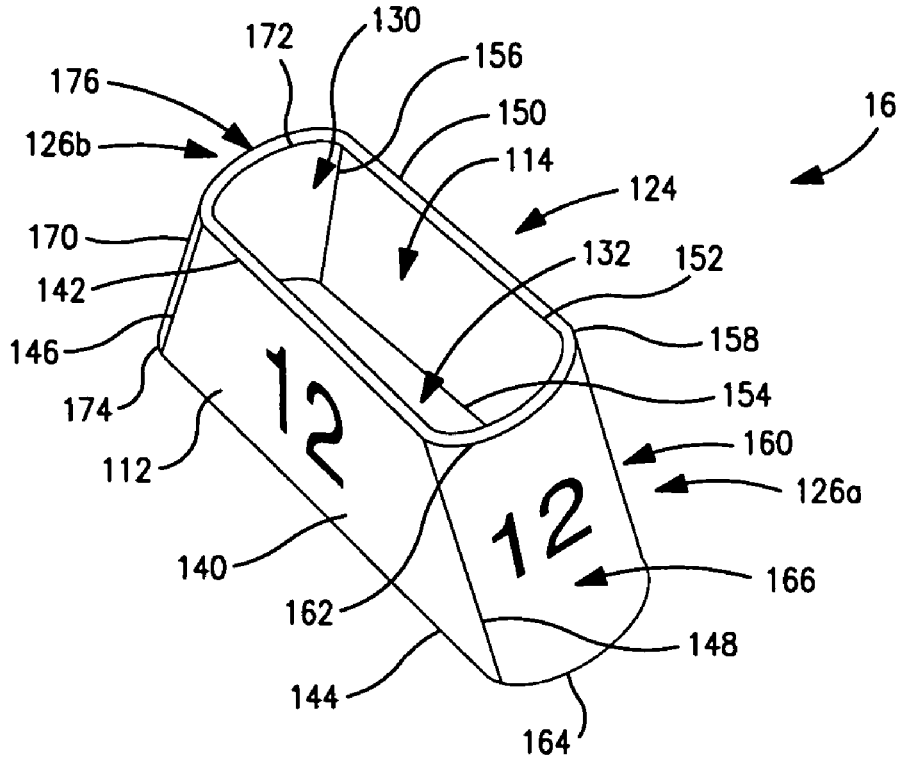
FIG. 5 of the drawings is a perspective view of the sizer of the garment hanger of the present invention.

Referring now to the drawings and in particular to FIG. 1, garment hanger 10 is shown in FIG. 1 as comprising body 12, hook 14, and sizer 16 (FIGS. 5 and 6). Typically body 12 is formed from a polymer resin material such as, for example, styrene-butadiene. One such material is commonly referred to as K RESIN and is manufactured by Phillips petroleum. Another material manufactured by BASF is sold under the name SYROLUX. Of course, the material is not limited to the foregoing.

Hook 14 is shown in FIG. 1 as comprising a separate member which is formed from a metal or alloy thereof. In the embodiment shown, hook 14 is a separate member which is attached to the body 12 and typically freely rotatable thereagainst. In other embodiments, the hook member may be fixed to the body. In still other embodiments, the hook member may be integrally molded with the body 12, and thereby formed from similar or identical materials.

Body 12 includes central region 20, first leg 22, second leg 24, sizer attachment assembly 40 and depending slot assembly 41. Typically, the foregoing members and assemblies are integrated into a single molded member. However, the invention is not limited thereto.

More specifically, the first leg 22 extends in a first, generally downward and outward direction from the central region. Second leg 24 extends in a second, generally downward and outward direction from the central region in a direction opposite that of the first leg. Structurally, the central region and the two leg regions comprise a generally "I" beam construction having top flange 26, bottom flange 28 and web 29 therebetween. The top and bottom flanges meet at opposing ends inasmuch as the two flanges cooperate to extend substantially about the perimeter of the body. Additional flanges, such as central region flange 21 may be included to add rigidity to the body of the garment hanger. Typically, the flanges may vary in dimension and the web may vary in thickness. Ridges, such as ridges 23 may be provided on a top flange 26 proximate the outer ends of the leg members so as to provide a resistance to the outward and downward movement of a garment.

The first leg will be described in detail below with the understanding the second leg is substantially identical thereto. In particular, first leg 22 includes proximal end 30, distal end 32, top end 34, bottom end 36, strap slot 38, secondary hook 39.

Figure 2:
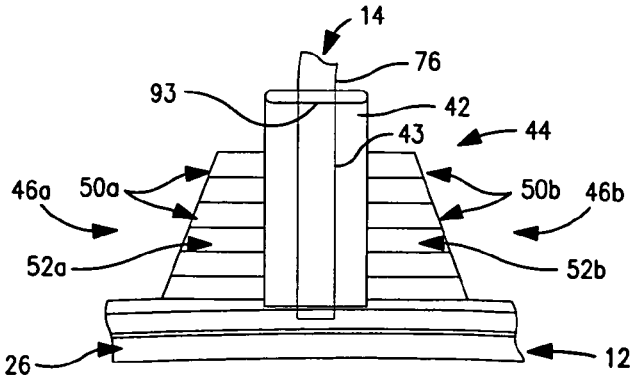
FIG. 2 of the drawings is a partial front plan view of the garment hanger of the present invention, showing, in particular, the hook boss of the present invention.
Figure 3:
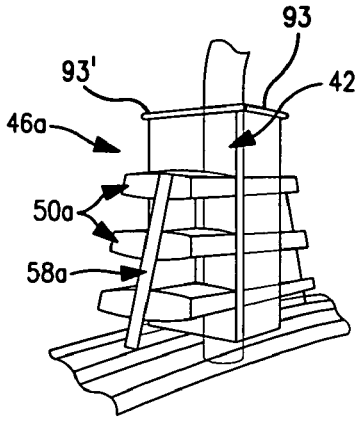
FIG. 3 of the drawings is a partial perspective view of the garment hanger of the present invention, showing, in particular, the hook boss of the present invention.
Figure 4:
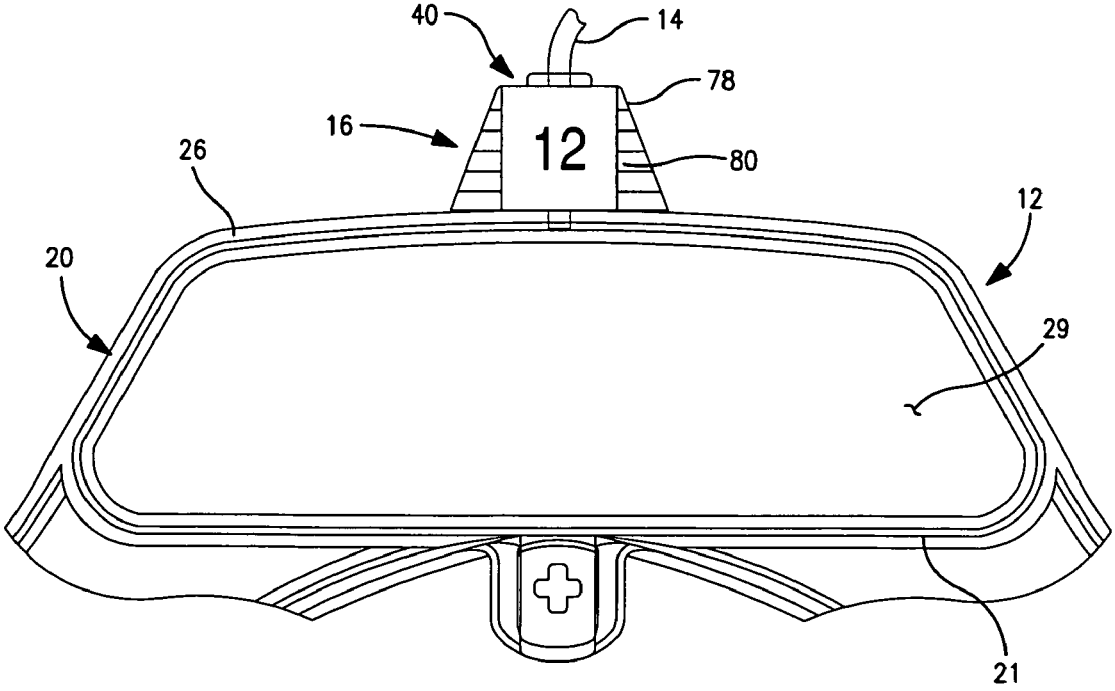
FIG. 4 of the drawings is a partial front view of the garment hanger of the present invention, showing, in particular, the sizer positioned thereupon.

Sizer attachment assembly 40 is shown in greater detail in FIGS. 2 and 3 as comprising central base 42, hook boss 43 and means 44 for attaching a sizer. The central base 42 extends from top flange 26 of the central region 20 of body 12, and essentially forms hook boss 43. The hook boss accepts the hook therein and retains same (although the hook is allowed to rotate within the hook boss in certain embodiments). In other embodiments, the hook may be integrally molded with the central base/hook boss.

The sizer attaching means 44 comprises first opposing buttress 46*a* and second opposing buttress 46*b*. The buttresses typically form a triangular configuration utilizing the central region top flange 26 and the side surface of the central base 42. The first opposing buttress 46*a* includes a plurality of flanges such as flanges 50*a*. In the embodiment shown, three substantially parallel flanges are shown, which flanges are each successively longer and each substantially parallel to top flange 26, locally. Web 52*a* extends between the flanges substantially perpendicular to the flanges and parallel with web 29 of the body.

The second opposing buttress is substantially a mirror image of the first opposing buttress. As such, the second opposing buttress will not be described in detail herein, and it will be understood that identical reference numbers augmented with a "b" are utilized therewith.

The buttresses provide a plurality of structures with which a sizer can be mated. In particular, and as will be explained, a sizer can grasp and retain any one of a number of different features of the buttresses. Of course, the buttresses provide an aesthetic appearance even where no sizer is utilized.

The sizer attachment means may likewise comprise other structures which are associated with the central base. For example, flanges 93, 93' (FIG. 3) may be disposed on a face of the central base 42 so as to retain the sizer after the sizer is slid beyond the flange. The flange provides a means by which to retain the sizer on the sizer attachment assembly.

The present sizer is not limited to use with the particular sizer attachment assembly. Specifically, other sizer attachment assemblies are contemplated for use, such as the sizer attachment assembly is shown in U.S. Publication No. 2006/0006204 A1 published on Jan. 12, 2006, to Mario Mainetti, the entire specification of which is hereby incorporated by reference.

As is shown in FIG. 1, depending slot assembly 41 includes a front wall 86, rear wall 88 and joining wall 89 spanning between the front and rear walls. An opening 90 may be provided in the rear wall (and a similar opening may be provided in the front wall (not shown)). The front and rear walls along with the joining wall define slot 92 through which a hook of another garment hanger can be inserted. Due to the configuration of the slot (i.e., substantially perpendicular to the web of the body), a hook extending through the slot 92 is substantially parallel with the plane defined by the web 29 of body 12. Any number of configurations of the depending slot are contemplated.

Hook 14 is shown in FIG. 1 as comprising head end 74 and tail end 76. In the embodiment shown, the head end is configured with a typical radius so as to engage outside hanging surfaces. The tail end 76 is configured so as to engage the hook boss and to be retained thereby. As set forth above, the hook 14 may be a separate member or may be integrally molded with the body 12 of the garment hanger.

Sizer 16 is shown in FIGS. 1 and 2 as comprising body 112 and cavity 114. The body 112 includes outer surface 120, inner surface 122. The inner surface defines the cavity 114 and includes upper opening 130 and lower opening 132. The openings are positioned on opposing sides of each other, and generally the lower opening 132 is larger than the upper opening 130. The sizer 16 is generally molded of a polymer material, although other configurations and materials are contemplated.

The sizer further includes central region 124 and end regions 126*a*, 126*b*. The central region includes first wall 140 and second wall 150. The first wall includes top edge 142, bottom edge 144, first side end 146 and second side end 148. The second wall includes top edge 152, bottom edge 154, first side end 156 and second side end 158. The first and second walls 140, 150 are substantially identical to each other and spaced apart a distance so that the sizer can be slid over the sizer attachment assembly on the garment hanger. Generally, in the embodiment shown, the first and second walls are generally trapezoidal in shape. Of course, other configurations, such as parallelograms, rectangles, ellipses, as well as arbitrary shapes are contemplated for use. The first and second walls are typically elongated relative to the width of the sizer (i.e., the distance between the first and second walls.

The end regions 126*a*, 126*b* span between the first wall and the second wall at opposing side ends thereof. For example, the end region 126*a* includes first curved wall 160 having upper edge 162, lower edge 164 and peak region 166. In the embodiment shown, the first curved wall 160 comprises a conical section that spans between the first wall and the second wall in an arcuate configuration with a predetermined radius of curvature. In such an embodiment, the peak region 166 is positioned directly between the first and second walls.

The end region 126*b* includes second curved wall 170 which has upper edge 172, lower edge 174 and peak region 176. The second curved wall may be configured much like the first curved wall. In the embodiment shown, the first and second end regions are substantial mirror images of each other taken about the midpoint of the sizer. Additionally, indicia (such as sizing information) can be placed upon the end regions so as to be visible from multiple angles. Of course, sizing information can be placed upon the first and second wall instead or in addition.

While the first and second walls are shown as being substantially planar, with the end regions being substantially conical configurations (or cylindrical configurations), it is also contemplated that the first and second walls comprise non-planar surfaces having a certain curvature that blends into each of the first and second curved walls. Thus, the curved walls includes a substantially more pointed peak region, and the cross-sectional configuration comprises a substantially football-like configuration.

Figure 6A:
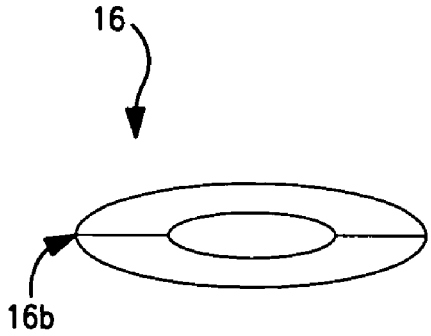
FIGS. 6*a* and *b* of the drawings are each of a top plan view of various sizers of the garment hanger of the present invention.
Figure 6B:
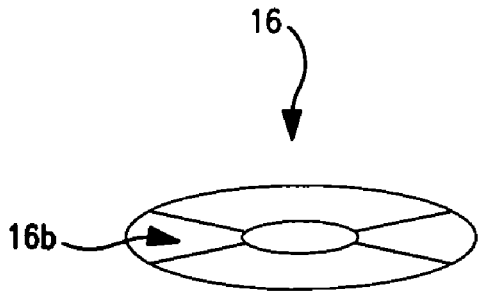

Of course, other configurations, such as a combination of the foregoing embodiments, as well as others are contemplated for use. Certain such configurations are shown in FIGS. 6*a* and 6*b*. It will be understood that these are considered to be exemplary solely, and not to be deemed limiting.

In each such embodiment, the end regions having curves facilitate the attachment and detachment of the sizer from the garment hanger. Specifically, the user can press the end regions toward each other (by, for example pinching). The pressing of the end regions toward each other expands at least the lower opening, if not both the upper and lower openings thereby spacing the first wall and second wall further apart from each other (and widening the openings). This allows for the sizer apparatus to be installed and removed from the sizer attachment assembly. Stated another way, the curved end regions define a means for expanding the upper and lower openings of the cavity defined by the inner surface of the body.

To assemble the garment hanger of the present invention, the body 12 is first provided. Once provided, the hook can be coupled to the body (where a separate hook member is provided). Specifically, tail end 76 of hook 14 is inserted into hook boss 43 and releasably retained thereby. In certain embodiments, the body is heated (i.e., softened), whereupon the tail end of the hook is inserted. The body is then cooled which results in a coupling of the two components.

To install the sizer, the user simply pinches the end regions toward each other driving the first and second wall away from each other and temporarily widening the upper and lower openings of the cavity. Next the user can slide the sizer apparatus over the sizer attachment assembly. Once installed over the sizer attachment assembly, the user releases the end regions and the sizer returns to its original configuration. The original configuration is such that the sizer grasps and retains the sizer attachment assembly. In certain embodiments, the sizer is coupled though an interference fit with the sizer attachment assembly. In other embodiments, such as the embodiment shown in FIGS. 1 through 4, the flange 93, 93' is positioned at the upper end of the sizer attachment assembly, which precludes removal of the sizer in its natural (unpinched) configuration.

To remove the sizer from the garment hanger, the user again pinches the end regions toward each other to expand the upper opening and the lower opening. Once expanded, the sizer can be decoupled from the sizer attachment assembly quite easily. The configurations can be varied and the relative thicknesses of the body regions can be varied so as to set a predetermined force that needs to be applied to the end regions toward each other to achieve the desired widening of the upper and lower openings to allow for removal of the sizer from the garment hanger. For example, the walls may include regions which are relatively thin compared to other regions. In turn, the first and second wall will deform predictably and at predetermined regions or areas. Additionally, it is contemplated that the force could be such that the a child would have a difficult time pinching the end regions with sufficient force to expand the upper and lower openings sufficiently to remove the sizer from the sizer attachment assembly.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method of installing a sizer comprising the steps of:

providing a garment hanger having a body, a hook, having a base, coupled to the body, and a sizer attachment assembly positioned at the base of the hook;

providing a sizer comprising:

a body having an outer surface and an inner surface, the body defining a hoop-like configuration having a cavity with an upper opening and a lower opening, the body having a central region defined by a first wall and a second wall opposing the first wall and spaced apart therefrom, and, a pair of opposing end regions defined by a first curved wall spanning between the first wall and the second wall and a second curved wall spanning between the first wall and the second wall at an end opposite the first curved wall, the first and second curved walls being outwardly convex defining a peak region on each of the first and second curved walls, whereupon applying a pinching force upon the first and second curved walls toward each other drives the first wall and second wall further apart, to, in turn, temporarily widen at least one of the lower and the upper openings of the body;

extending a hook through the sizer until the sizer approaches the base of the hook and the sizer attachment assembly;

applying a pinching force upon the first and second curved walls, to, in turn, alter the shape of at least one of the lower and the upper openings of the body to temporarily widen the same beyond a width of the sizer attachment assembly;

passing the sizer over the sizer attachment assembly; and releasing the pinching force from the first and second curved walls, returning the sizer to an unaltered condition, thereby securing the same to the sizer attachment assembly.

2. The method of claim 1 wherein the step of applying a pinching force further comprises the step of widening the at least one opening a predetermined width which is wider than the width of a flange positioned on the garment hanger, and wherein the step of passing the sizer further comprises the step of passing the sizer over the flange.

3. The method of claim 1 further comprising the steps of:

applying a pinching force upon the first and second curved walls, to, in turn, alter the shape of at least one of the lower and the upper openings of the body to temporarily widen the same beyond a width of the sizer attachment assembly;

passing the sizer back over the sizer attachment assembly; and passing the sizer back over the hook so as to fully separate the sizer from the garment hanger.

* * * * *